US006347718B1

(12) United States Patent
Karpisek

(10) Patent No.: US 6,347,718 B1
(45) Date of Patent: Feb. 19, 2002

(54) CONTAINERS

(76) Inventor: Ladislav Stephan Karpisek, 86 Woodfield Boulevarde, Caringbah, New South Wales 2229 (AU)

( * ) Notice: Subject to any disclaimer, the term of this patent is extended or adjusted under 35 U.S.C. 154(b) by 0 days.

(21) Appl. No.: 09/462,236

(22) PCT Filed: Jul. 7, 1998

(86) PCT No.: PCT/AU98/00523

§ 371 Date: Jan. 3, 2000

§ 102(e) Date: Jan. 3, 2000

(87) PCT Pub. No.: WO99/02413

PCT Pub. Date: Jan. 21, 1999

(30) Foreign Application Priority Data

Jul. 9, 1997 (AU) ..... PO7779

(51) Int. Cl.[7] ..... B65D 88/00; B65D 19/12
(52) U.S. Cl. ..... 220/1.6; 206/600; 222/105
(58) Field of Search ..... 222/105, 95; 206/600; 220/1.6; 229/117.3

(56) References Cited

U.S. PATENT DOCUMENTS 3,325,085 A * 6/1967 West, Jr. ..... 222/146.5
4,934,654 A * 6/1990 Linnemann ..... 229/117.3 X
5,056,667 A * 10/1991 Coogan ..... 206/600
5,269,414 A * 12/1993 D'Hollander ..... 206/600
5,316,174 A * 5/1994 Schutz ..... 220/571
5,356,029 A * 10/1994 Hogan ..... 229/117.3
5,441,321 A * 8/1995 Karpisek ..... 294/68.21
5,445,289 A * 8/1995 Owen ..... 222/105
5,520,121 A * 5/1996 Schubart et al. ..... 108/57.1
5,799,812 A * 9/1998 Mansouri ..... 206/600

FOREIGN PATENT DOCUMENTS

GB 2162153 * 1/1986

* cited by examiner

*Primary Examiner*—Allan N. Shoap
*Assistant Examiner*—Joseph C. Merek
(74) *Attorney, Agent, or Firm*—Edwin D. Schindler

(57) ABSTRACT

A container including a four sided base having a trough extending part of the way across the base upper face, a nozzle support at the mouth of the trough to support a linear bag nozzle in the trough mouth with a liquid discharging bore portion of the nozzle below the level of the upper face of the base, four container side panels for erection at the four sides of the base with one of the side panels has a nozzle panel. A nozzle aperture in the nozzle panel positioned so as to be aligned with the trough mouth when the nozzle panel is erected on the base and a releasable nozzle retainer on the nozzle panel.

11 Claims, 5 Drawing Sheets

CONTAINERS

FIELD OF THE INVENTION

This invention relates to a container for use with a plastic liner bag to hold a liquid or a liquefiable material (hereinafter simply both called liquids) where the container is adapted to allow the liner bag contents to be discharged through an opening in a discharge side of the container.

PRIOR ART

A container for the above purpose is of usually of the collapsible type having a base and four side panels able to be erected at the four edges of the base and which are interconnectable to provide a liner bag supporting enclosure. The container is usually provided with a lid. The base is usually of the 'pallet' type allowing ready movement of the container by means of a fork lift truck or pallet hand truck. Two forms of collapsible container are common. In one form the side panels can be completely removed from the base and in the other form the container side panels are coupled to the base and are able to be moved between a folded down condition where they overlie each other and the base to an erected condition on the base.

For liquid liner bag use one of the sides of the container is a discharge side adapted to allow a nozzle of the liner bag to project from within the container so a liquid discharge valve or other device can be coupled to the nozzle. The bag nozzle is engagable by a retainer to keep it in a projecting condition ready for a valve or other device to be coupled to it.

One form of retainer is disclosed in Australian patent 556931 by the present applicant.

BACKGROUND TO THE INVENTION

The present invention has as a primary object the provision of means to allow substantially complete emptying of the liner bag. In the prior art containers the nozzle was supported in the projecting condition at an elevation above the base and as a result some liquid remained in the liner bag after gravity discharge of the liquid from the nozzle had ceased. Hitherto, the accepted solution to this problem was to manually raise the liner bag to cause the remaining liquid to discharge through the nozzle. The present invention provides a modified container construction which will allow substantially complete gravity discharge of liquid from a liner bag.

In the development of the present invention another problem with containers of the above type was considered. It has been common practice to this time to provide all liner bags for use in the above described containers with the same size nozzle. Whilst the almost universally adopted nozzle size allowed ready discharge of liquids of low viscosity the size of the nozzle was found unsuitable where a very rapid discharge of low viscosity liquids is required and is not able to provide adequate discharge rates for high-viscosity liquids.

One solution for this problem is to provide liner bags with nozzles of different sizes allowing a container user to select the size nozzle appropriate for the type of liquid, or a required discharge rate for liquid, in the container. It has been determined by experiment that two sizes of nozzle will satisfactorily cope with most liquid types and required discharge rates.

The adoption of different nozzle sizes poses a problem for the container maker as the nozzle retainer on the container discharge side, which hitherto had only to work with a single nozzle size, must now be able to work with multiple nozzle sizes. With this in mind a nozzle retainer able to work with two different nozzle sizes has been devised. The retainer is also capable of covering the nozzle receiving opening in the container discharge side thereby allowing the container to be used without a liner bag to house discrete material.

BROAD STATEMENT OF THE INVENTION

A container including a base with an upper face and four sides one of which is a discharge side, a trough in the base extending part way across the base upper face from a trough mouth at the discharge side of the base, nozzle support means to support a liner bag nozzle in said trough mouth with a liquid discharging portion of said nozzle below the level of said upper face of said base, and including four container side panels for erection at the four sides of the base with one of the side panels a nozzle panel, a nozzle aperture in said nozzle panel positioned so as to be aligned with the trough mouth when the nozzle panel is erected on the base, and releasable nozzle retainer means on the nozzle panel.

DETAILED DESCRIPTION OF THE DRAWINGS

Figure 1:
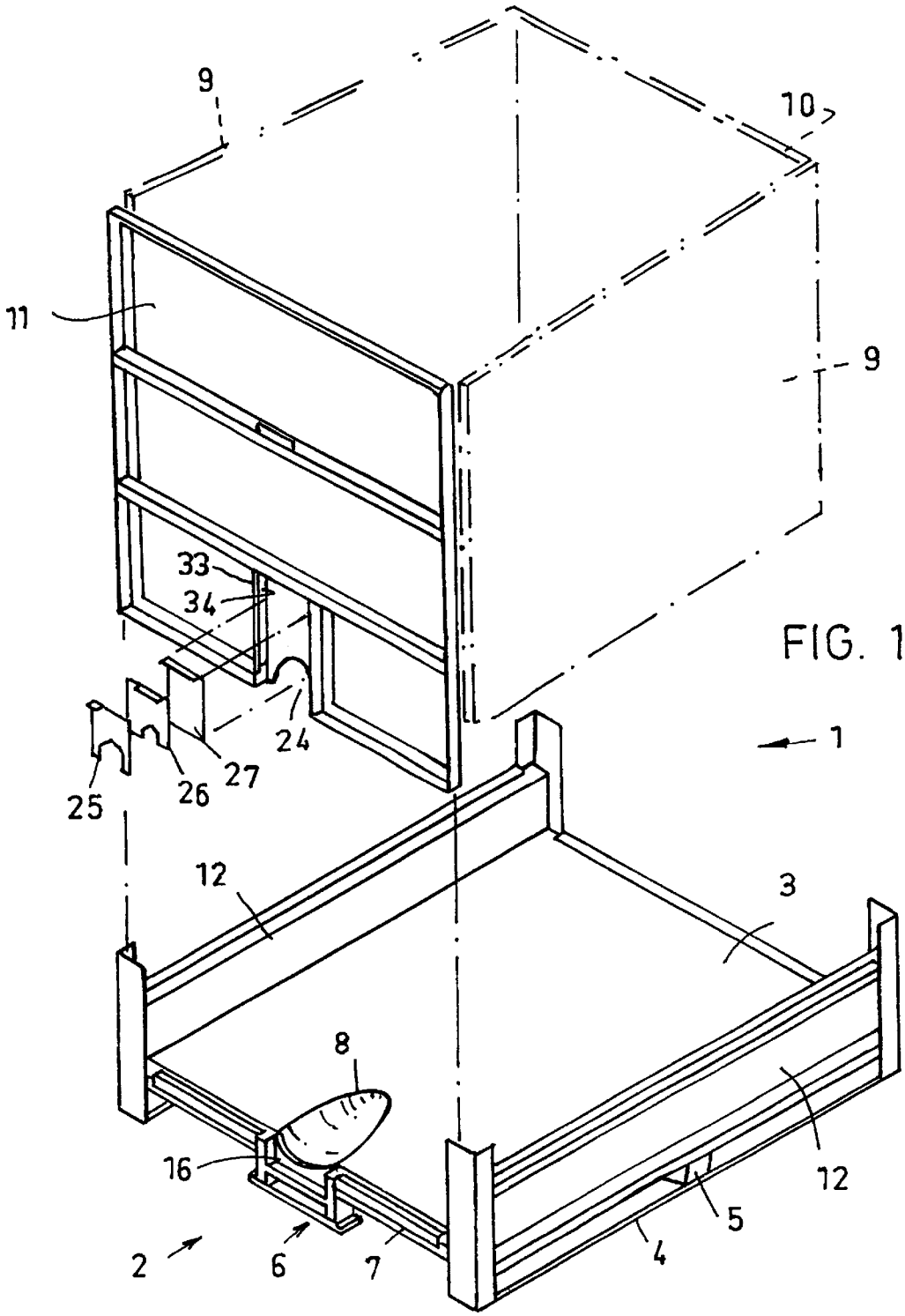
FIG. 1 is an exploded schematic view of one form of container with the base and a side panel illustrating the present invention has been applied.

FIG. 1 schematically illustrates a container 1 including a base 2 of the pallet type with an upper surface 3, lower support bars 4 and spacers 5 sized and positioned to allow the entry of fork lift truck tines or a pallet truck between the spacers 5. There is a spacer 6 of special form at the discharge side 7 of the base to accommodate a mouth end of a trough 8 which extends inwardly across the base. As illustrated the trough 8 increases in width and depth at it approached the discharge side 7 of the base. It is to be understood that this is a preferred configuration and the trough could be of uniform width and/or of uniform depth.

Four side panels are illustrated, the side panels can be demountably connected to the base at the sides of the base so as to be upstanding relative to the base or be coupled to the base to allow the panels to fold down in overlying relationship over the base and be raised to an upstanding condition relative to the base. Examples of demountable and foldable arrangements are to be found in Australian patents 676087, 684859, 665635, 643812 and 694001 by the present applicant. The way in which the side panels are mounted on the base is not relevant to the present invention and for that reason no detail of side panel to base connections are provided herein.

As illustrated in FIG. 1 two side panels 9 are the same and shorter than the two side panels 10 and 11. The side panels are intended to be the fold down type with the shorter side panels 9 when erected upstanding from the plinths indicated 12 at opposite sides of the base and the side panels 10 and 11 upstanding from the top surface of the base 2. The side panel 11 differs from the side panel 10 in that it is adapted for use with a container liner bag for liquid.

Figure 2:
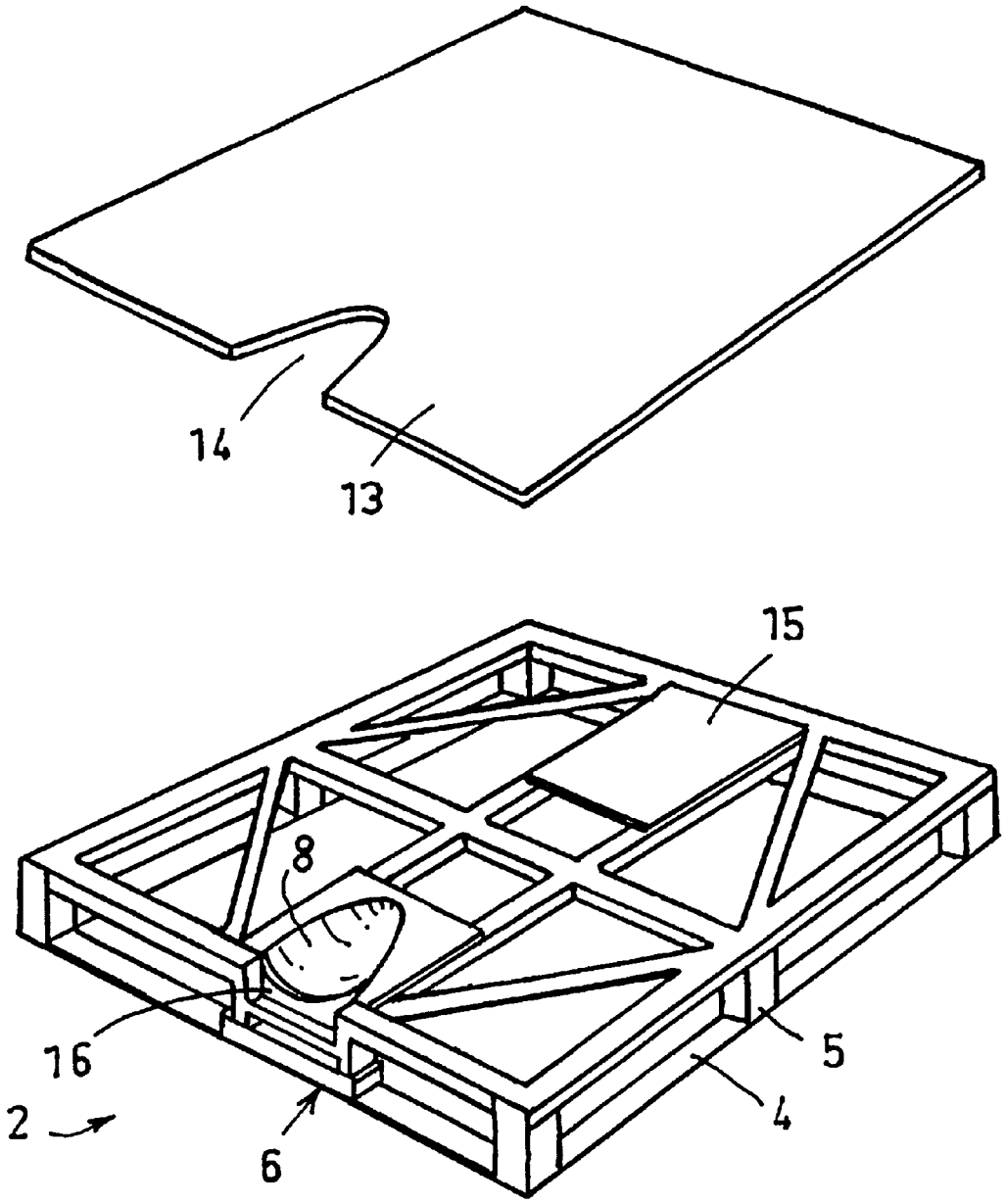
FIG. 2 is an exploded view of a base different to that shown in FIG. 1.
Figure 3:
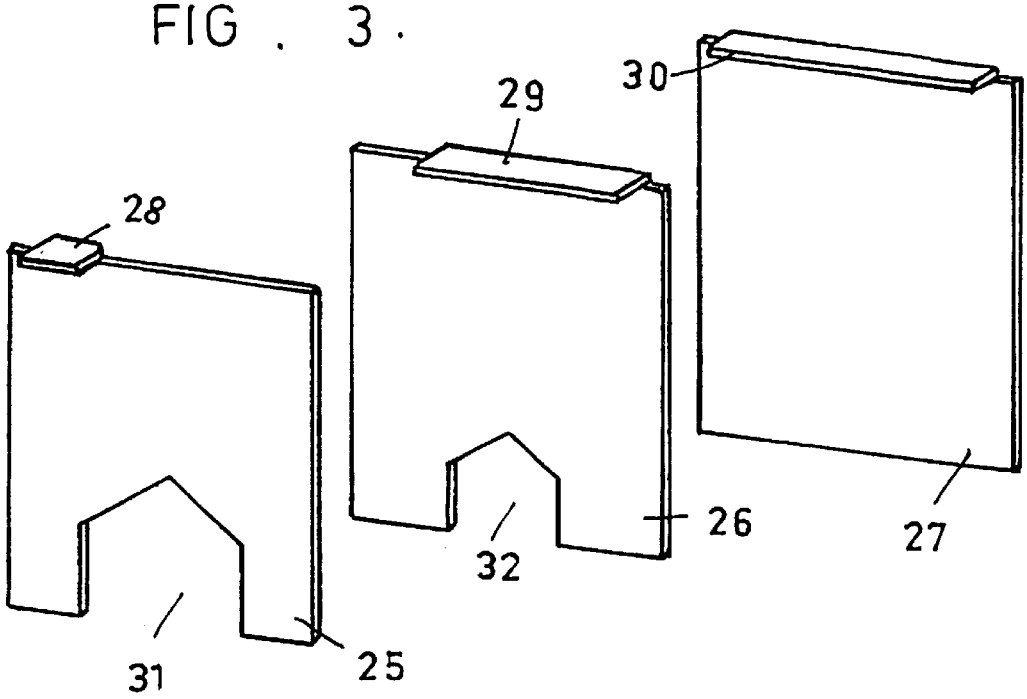
FIG. 3 is a perspective view of elements of a bag nozzle retainer shown generally in FIG. 1 to a larger scale.

FIG. 2 illustrates another form of container base, it is of skeletal form and the upper surface is provided by a floor sheet 13. The floor sheet 13 is provided with a notch 14 to border the edges of the trough 8. There is a panel 15 fixed to the base to lie below the notch 14 in the event the floor sheet 13 is turned end for end, as is sometimes desirable for the reasons to be described later. This form of base may be provided with plinths 12 or may be of the type to which side panels of equal height are demountably coupled.

At the mouth of the trough 8 there is means to support the nozzle of a liner bag. The support means can be of several forms. In the form illustrated in FIG. 4 the trough terminates behind a support bar 16 forming part of the spacer 6. Alternatively, the support bar 16 could be an end flange 16*a* at the large end of the trough 8, see FIG. 4. As will be seen from FIG. 5, the liner bag 17 has a nozzle indicated generally 18 including a tubular nozzle body 19 resting on the bar 16, The body has a threaded neck fitted with a cap 20 and there is a flange 21 which, when the nozzle is mounted in a side panel 11, lies in front of the bar 16. The nozzle 18 includes a rear flange 22 whereby the nozzle is fixed by welding to the liner bag 17. There is a membrane 23 over the inner end of the nozzle bore. The contents of the liner bag is thus retained in the liner bag until the membrane 23 is ruptured.

It is to be noted that the liner bag follows the profile of the trough 8 and that the lowest point of the bore of the nozzle body 19 lies below the surface 3 of the base 2. The result is that all liquid from the bag with the exception of the very small quantity occupying the zone "L" will discharge from the liner bag.

The support surface of the bar 16, and the trough flange if used as an alternative to the bar 16, is curved or otherwise profiled along the upper face to locate the nozzle body 19 relative to nozzle retaining means to be described later. Where the nozzle body 19 rearward of the flange 21 is multi-sided, frequently this portion of the nozzle body is of hexagonal shape, the upper surface of the bar 16 can be profiled to co-operate with faces of the multi-sided body.

Figure 4:
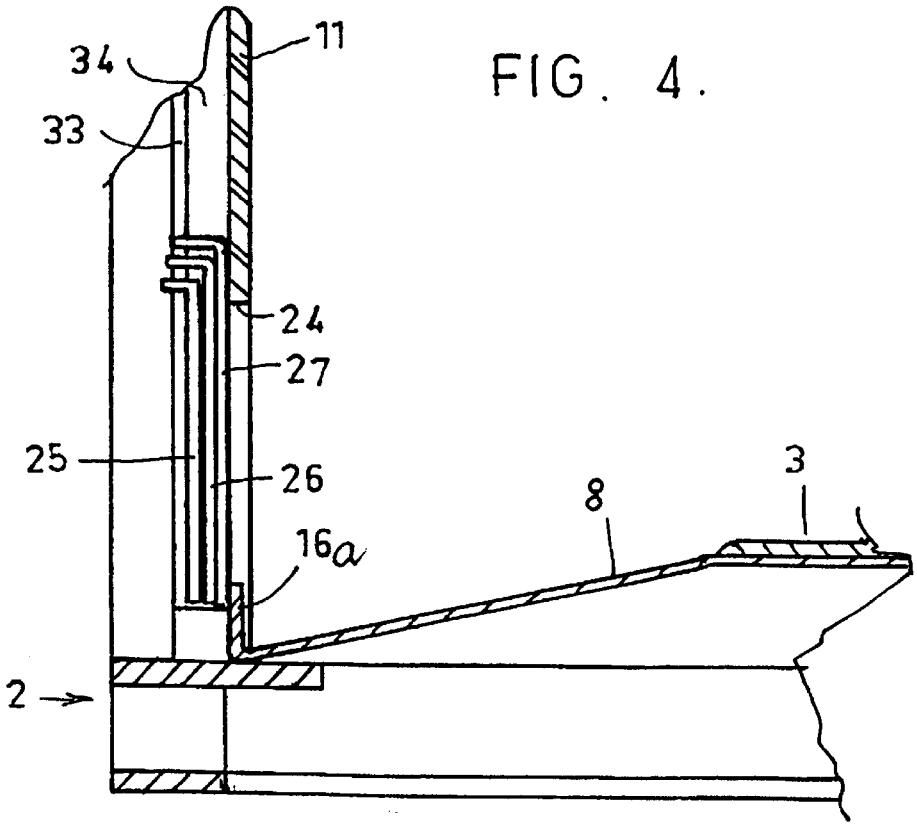
FIG. 4 is a schematic side view in which the elements of FIG. 3 are shown mounted in an operative relationship in a container side panel.

The side panels for containers of the type with which the present invention is proposed conventionally comprise a tubular steel or angle iron frame with a cover sheet, the cover sheets provide smooth inner faces for the liner bag enclosure comprised of the base and the side panels. The container side 11 (see FIG. 1) incorporates a nozzle aperture 24 in the form of a notch which is large enough to allow the flange 21 of the nozzle to pass there through. In a liner bag loading sequence with the panel 11 mounted in an upstanding condition on the base 2, the nozzle without the cap 20 can be inserted from within the container through the notch 24. The flange 21 will pass through the notch but the larger nozzle flange 22 will not and when the nozzle 18 is then lowered to rest on the profiled top edge of the bar 16 the relationship of the members will be as shown in FIG. 4.

The retaining means proposed for the nozzle comprises a plurality of shutters illustrated in FIGS. 1,3,4,5, the illustrated arrangement is for use with two nozzles of different size. There are three shutters of slightly different heights, the shortest shutter is indicated 25, the intermediate length shutter is indicated 26 and the longest shutter is indicated 26. The shutters are plates with a top edge flanges 28,29,30 respectively and the shutters 25 and 26 have lower edge notches 31 and 32 respectively. The notch 31 has a width slightly greater than the outside diameter of the tubular body of the larger of the nozzles proposed and the notch 32 is for the other (smaller) nozzle. Where a nozzle with a hexagonal exterior body shape is used the width of the notches 31,32 could be such as to engage oppositely disposed faces of the nozzle body. Such engagement provides resistance to torque developed as the cap 20 is screwed onto and unscrewed from the threaded end of the nozzle body. This is a desirable arrangement as otherwise the developed torque would be transferred to the welded joint between the nozzle flange 22 and the liner bag 17. The shutters are slidably received in tracks 34 on the inner faces of the bars 33 forming part of the frame of the side panel 11.

Figure 5:
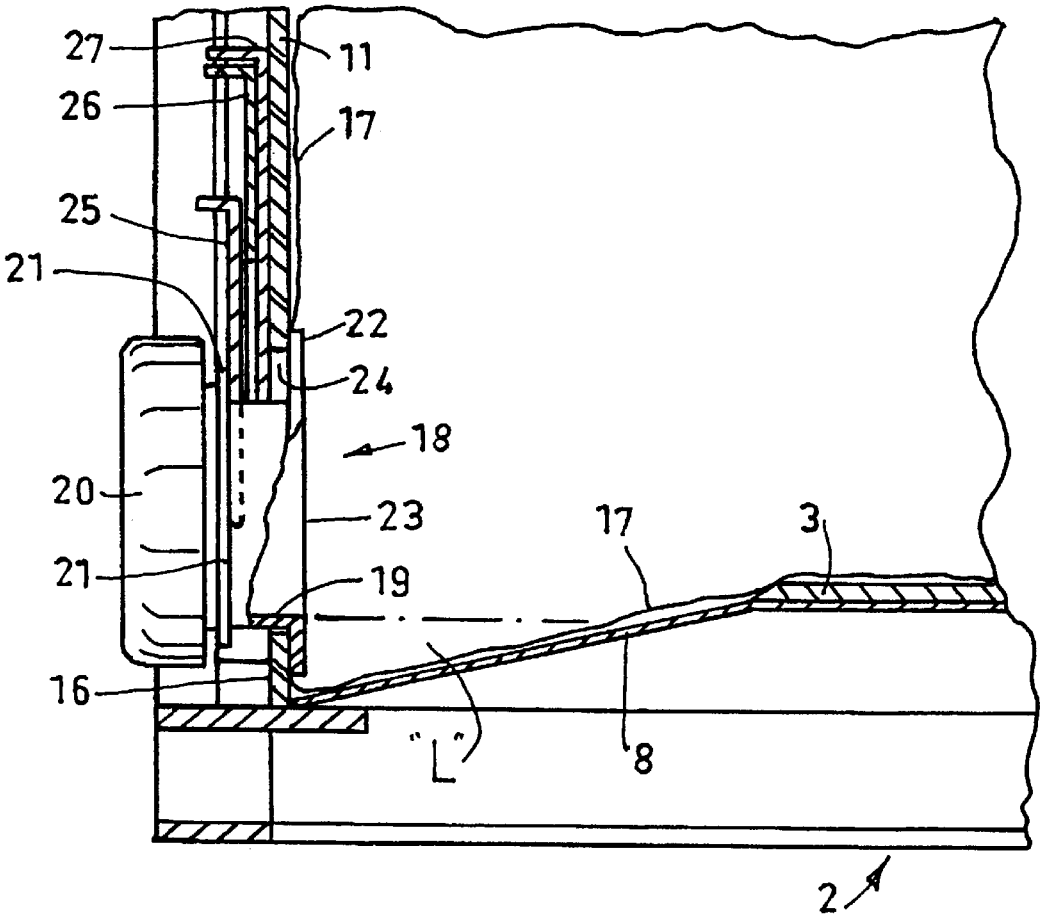
FIG. 5 is view similar to FIG. 4 showing a liner bag nozzle engaged by the retainer of FIGS. 3 and 4.
Figure 6:
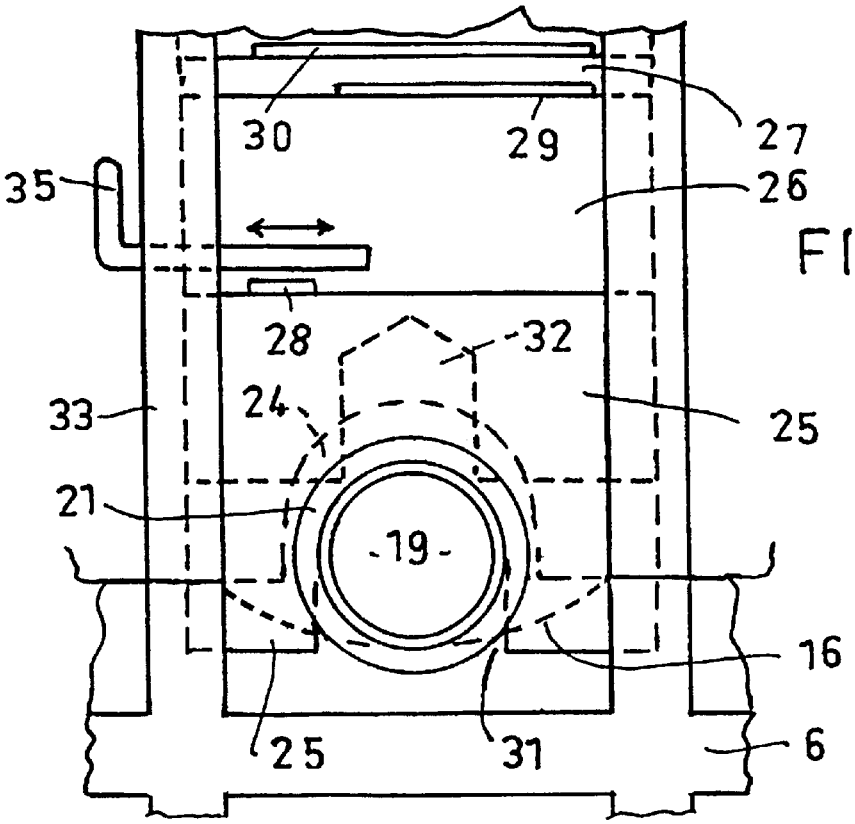
FIG. 6 is a fragmentary front view of a bag nozzle of a first size engaged by the retainer of FIGS. 3 to 5

Referring to FIGS. 5 and 6, it will be seen that shutter plate 25 is in a lowered position where the capless body 19 of the nozzle rearward of the flange 21 is received into the notch 31. This ensures the discharge end of the nozzle 18 is retained in the projecting condition illustrated. The shutter plate 26 will be retained in the raised condition as the notch 32 thereof cannot pass over the nozzle body and likewise the longest shutter 27 will remain raised as lower edge of the shutter will rest on the nozzle body 19. FIG. 6 also shows a slide bolt latch means 35 which when made operative overlies the flange 28 and prevent the shutter 25 from rising to release the nozzle 18.

From the forgoing description it follows that where there is no nozzle extending through the notch 24 all three shutters would be in the lowered condition and the shutter 27 would cover the notch 24 where it would be retained by the slide bolt 35. By reversing the floor sheet 13, previously discussed, the trough 8 would be covered, the notch 24 would be covered and the notch 14 of the sheet 13 would overlie the plate 15 and be covered. The result is a container with an uninterrupted inner surface able to carry discrete materials. The shutter system described therefore also provides a means for allowing a container to be used both for liquid and dry product storage or transportation.

In modifications of the forgoing constructions: The nozzle retainer may include only shutters with notches for engagement with liner bag nozzles.

The nozzle retainer may be comprised of more than two shutters each provided with a notch to suit a liner bag nozzle.

The nozzle retainer shutters 25 and 26 may have a relationship reverse to that described with reference to the drawings.

A latch means other than a slide bolt 35 may be provided for the nozzle retaining shutters.

A hinged or other cover means with its own security means may be provided to cover the nozzle retainer means to thereby prevent unauthorised access to the nozzle retainer means.

What is claimed is:

1. A container, comprising:

a base with an upper face and four sides one of said four sides being a discharge side;

a trough in said upper face of said base extending away from a trough mouth at said discharge side of the base;

a nozzle support at said trough mouth with a nozzle support surface for positioning a liquid discharging portion of a liner bag nozzle when supported by said nozzle support surface at a level below the level of said upper face of said base;

four container side panels for erection at the four sides of said base with one container side panel of said four container side panels being a nozzle panel;

a nozzle notch in a lower edge of the nozzle panel positioned to be aligned with said trough mouth when said nozzle panel is erect on said base and dimensioned for allowing a bag nozzle to pass through the notch over the nozzle support; and, releasable nozzle retaining means on said nozzle panel engagable with a bag nozzle projecting from said container for preventing said bag nozzle from retracting into said container, said nozzle retaining means comprising a plurality of shutters each of said shutters having a notched lower edge where notches are respectively sized for engaging with body portions of liner bag nozzles of different sizes.

2. The container according to claim 1, wherein said nozzle support is part of said base.

3. The container according to claim 1, wherein said nozzle support is profiled to laterally centralize said nozzle relative to the width of said trough.

4. The container according to claim 1, wherein said trough is a member demountably supported on said base and said nozzle support is an upstanding flange on said trough.

5. The container according to claim 1, wherein said releasable nozzle retaining means includes three shutters, two shutters of said three shutters including notched lower edges and a third shutter of said three shutters not being notched, thereby allowing said third shutter to be positioned over a nozzle aperture to occlude said nozzle aperture.

6. The container according to claim 5, wherein said plurality of shutters are slidably mounted on said nozzle panel.

7. The container according to claim 5, wherein said plurality of shutters are pivotally mounted on said nozzle panel.

8. The container according to claim 1, wherein said plurality of shutters are slidably mounted on said nozzle panel.

9. The container according to claim 1, wherein said plurality of shutters are pivotally mounted on said nozzle panel.

10. The container according to claim 1, further comprising latch means for preventing release of said releasable nozzle retaining means.

11. The container according to claim 1, further comprising a security cover for said releasable nozzle.

* * * * *